US008943675B2

(12) United States Patent
Fan

(10) Patent No.: US 8,943,675 B2
(45) Date of Patent: Feb. 3, 2015

(54) METHOD FOR MAKING A SHIELDED INDUCTOR INVOLVING AN INJECTION-MOLDING TECHNIQUE

(75) Inventor: Tso-Ho Fan, Tao-Yuan Shien (TW)

(73) Assignee: Superworld Electronics Co., Ltd., Tao-Yuan Shien (TW)

( * ) Notice: Subject to any disclaimer, the term of this patent is extended or adjusted under 35 U.S.C. 154(b) by 1014 days.

(21) Appl. No.: 13/035,929

(22) Filed: Feb. 26, 2011

(65) Prior Publication Data

US 2012/0216392 A1 Aug. 30, 2012

(51) Int. Cl.

| | |
|---|---|
| ***H01F 17/04*** | (2006.01) |
| ***H01F 27/28*** | (2006.01) |
| ***H01F 41/02*** | (2006.01) |
| ***H01F 27/36*** | (2006.01) |
| *H01F 27/29* | (2006.01) |

(52) U.S. Cl.

CPC ..... *H01F 41/0246* (2013.01); *H01F 27/365* (2013.01); *H01F 17/04* (2013.01); *H01F 27/292* (2013.01)

USPC ..... 29/606; 336/84 M

(58) Field of Classification Search

CPC ..... H01F 41/005; H01F 41/0246; H01F 2017/048; H01F 27/263; H01F 27/255; H01F 27/365; H01F 27/362; H01F 27/36; H01F 17/04; H01F 27/292

USPC ..... 336/84 M; 29/606

See application file for complete search history.

(56) References Cited

U.S. PATENT DOCUMENTS

| | | | | |
|---|---|---|---|---|
| 4,706,058 | A * | 11/1987 | Barbier et al. | 336/96 |
| 5,751,203 | A * | 5/1998 | Tsutsumi et al. | 336/65 |
| 6,204,744 | B1 | 3/2001 | Shafer et al. | |
| 6,460,244 | B1 | 10/2002 | Shafer et al. | |
| 2002/0084881 | A1 * | 7/2002 | Kummel | 336/200 |

* cited by examiner

*Primary Examiner* — Livius R Cazan

(74) *Attorney, Agent, or Firm* — Guice Patents PLLC

(57) ABSTRACT

A method for making a shielded inductor by: winding a metal wire material into a conducting coil and bending two distal ends of the metal wire material into a respective end piece, bonding a magnetic core to the center of the conductive coil, making a metal sheet member into a metal bracket having a frame body, solder points and connection strips, installing the conductive coil in the metal bracket and electrically soldering the end pieces of the conductive coils to respective soldering points at the metal bracket, mixing a magnetic material with a plastic material and processing the mixture into plastic grains, injection-molding the plastic grains onto the conductive coil to form an inductor body, and separating the respective connection strips with the inductor body from the metal bracket and bending the separated connection strips onto the bottom wall of the inductor body.

3 Claims, 3 Drawing Sheets

METHOD FOR MAKING A SHIELDED INDUCTOR INVOLVING AN INJECTION-MOLDING TECHNIQUE

BACKGROUND OF THE INVENTION

1. Field of the Invention

The present invention relates to inductor fabrication technology and more particularly, to a method for making a shielded inductor, which employs an injection-molding technique to make an inductor body for shielded inductor.

2. Description of the Related Art

In U.S. Pat. No. 6,204,744 and No. 6,460,244, a method for making a high current, low profile inductor is disclosed. This method of making a high current, low profile inductor includes a magnetic material completely surrounding a conductive coil to form an inductor body. As the inductor body is formed of a magnetic material, it provides a shielding effect, enhancing the effects of the inductor.

In the cited U.S. Pat. No. 6,204,744, the inductor body is free from ferrite materials, and made by uniformly mixing first and second powdered iron particles having electrical characteristics different from one another and then pressure-molding the uniform mixture around a wire coil and then sintering the molded mixture.

In the cited U.S. Pat. No. 6,460,244, powdered magnetic material free from voids is used, and pressure-molding is employed to mold powdered magnetic material into the desired external inductor body.

In the above two cited US Patents, pressure-molding is employed to make the inductor body. Employing the pressure-molding technique slows down the fabrication. During molding, the conductive coil must be put in the molding mold. Further, the mold design is complicated and not adjustable for molding an inductor body having a different configuration.

SUMMARY OF THE INVENTION

The present invention has been accomplished under the circumstances in view. It is one object of the present invention to provide a method for making a shielded inductor, which involves an injection-molding technique, facilitating fast fabrication and simplifying mold design. It is one object of the present invention to provide a method for making a shielded inductor, which involves an injection-molding technique, eliminating the drawbacks of the prior art design that employs a pressure-molding technique.

To achieve these and other objects of the present invention, a method for making a shielded inductor, includes the steps of (a) winding a metal wire material into a conducting coil and bending two distal ends of the metal wire material into a respective end piece, (b) bonding a magnetic core to the center of the conductive coil, (c) making a metal sheet member into a metal bracket having a frame body, solder points and connection strips, (d) installing the conductive coil in the metal bracket and electrically soldering the end pieces of the conductive coils to respective soldering points at the metal bracket, (e) mixing a magnetic material with a plastic material and processing the mixture into plastic grains, (f) injection-molding the plastic grains onto the conductive coil to form an inductor body, and (g) separating the respective connection strips with the inductor body from the metal bracket and bending the separated connection strips onto the bottom wall of the inductor body.

By means of mixing a magnetic material with a plastic material and processing the mixture into plastic grains and then molding the plastic grains onto the conductive coil to form an inductor body, the invention facilitates fast fabrication and simplifies mold design. Further, when the plastic grains are melted for injection-molding, it is flowable and practical for making inductor bodies having different configurations. Therefore, the invention shows significant improvement over the prior art design that employs a pressure-molding technique.

Further, the magnetic material and the plastic material are mixed subject to a predetermined ratio. Further, the magnetic material is an alloy. Further, the plastic material is selected from the polymeric material group of PE (polyethylene), PVC (polyvinyl chloride), PBT (polybothlene terephthalate), PC (polycarbonate), PS (polystyrene), ABS (acrylonitrile butadiene styrene, phenolic resin, LCP (liquid crystalline polymer) and epoxy resin that are suitable for injection-molding.

DETAILED DESCRIPTION OF THE PREFERRED EMBODIMENT

Figure 1:
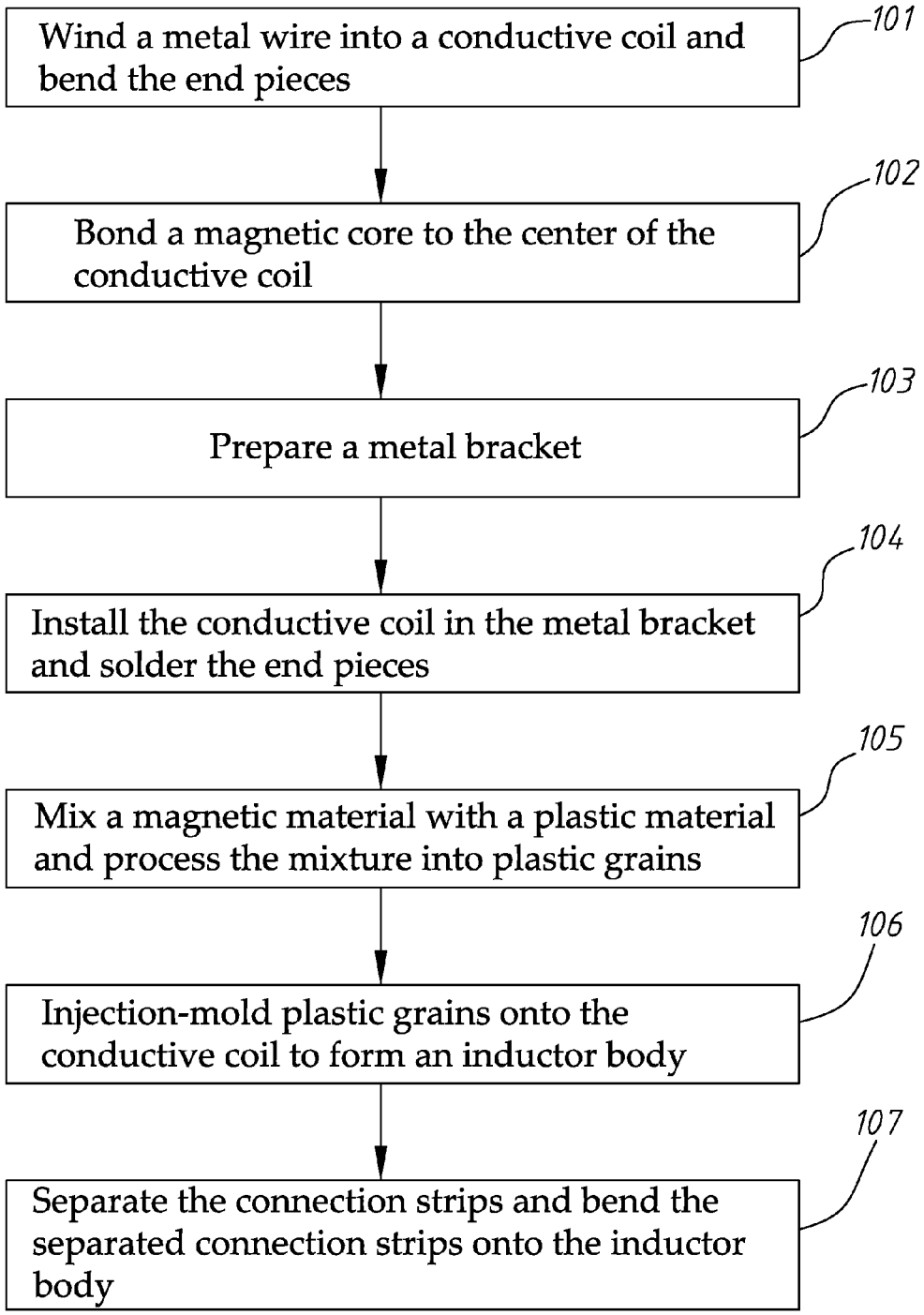
FIG. 1 is a manufacturing flow chart of the present invention.
Figure 2:
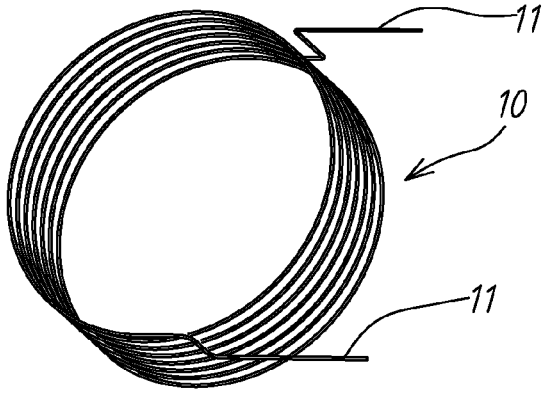
FIGS. 2-7 are schematic drawings illustrating every step of the shielded inductor making method in accordance with the present invention.
Figure 3:
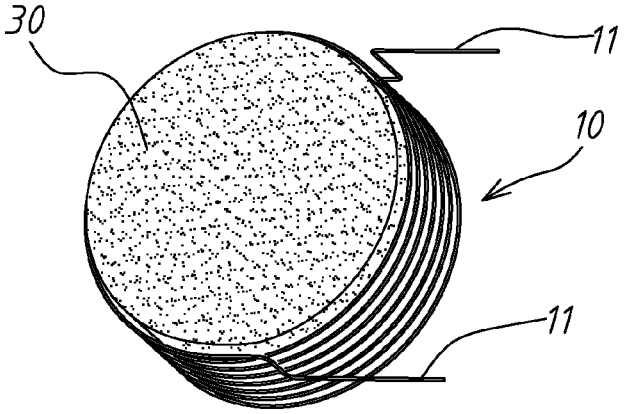
Figure 4:
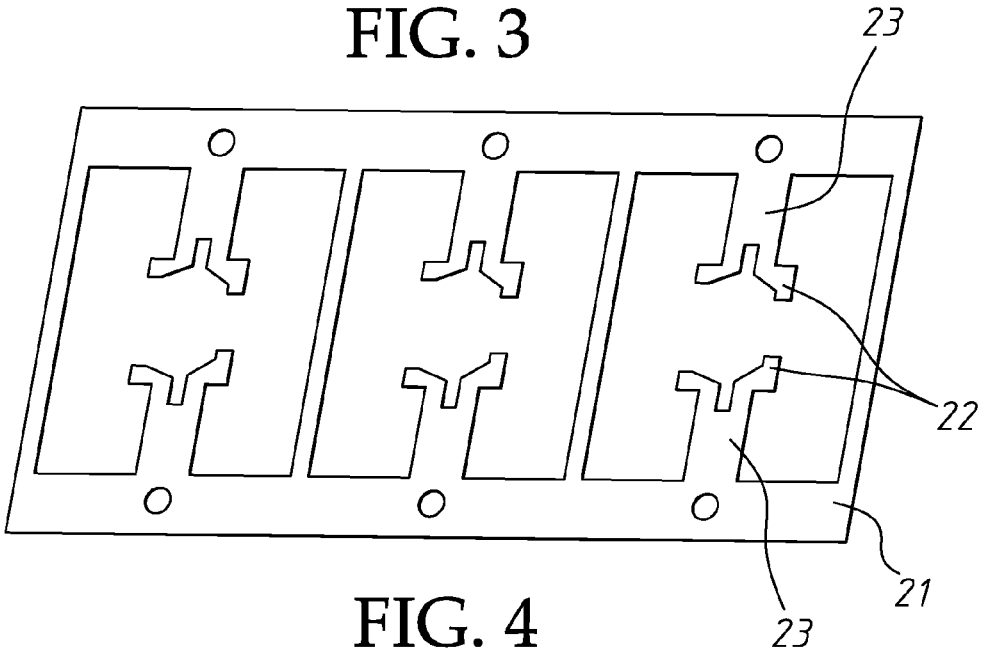
Figure 5:
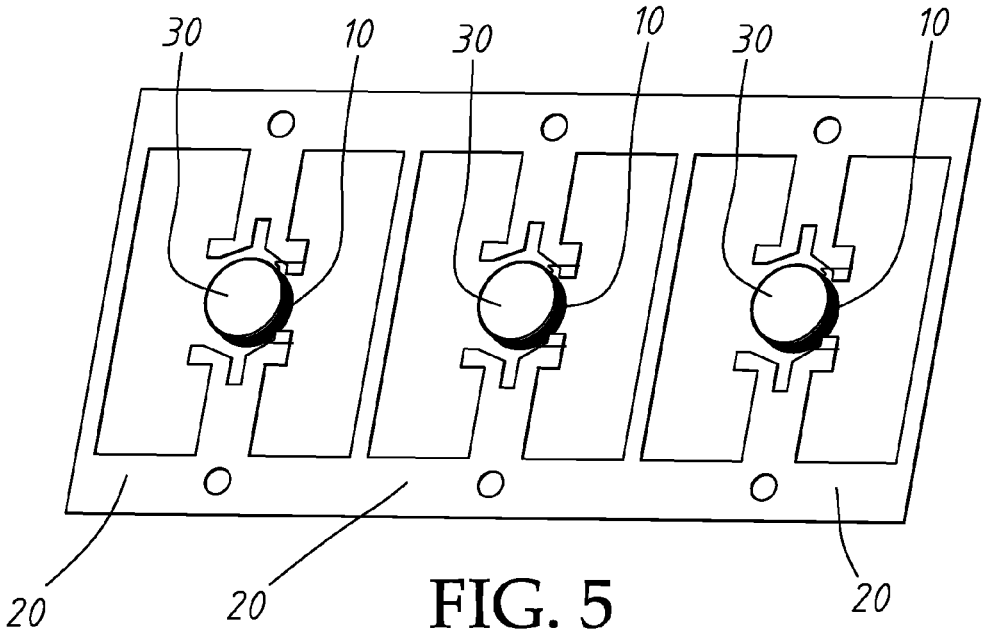
Figure 6:
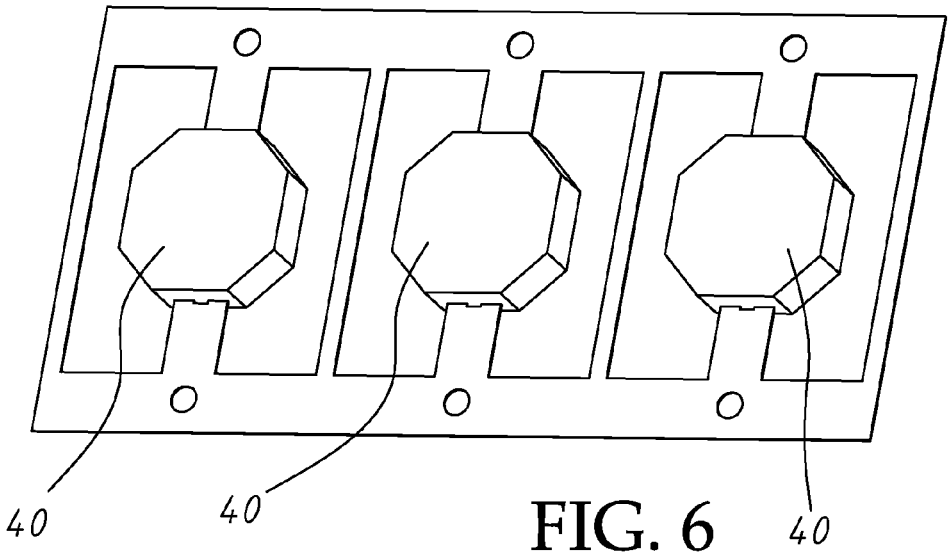
Figure 7:
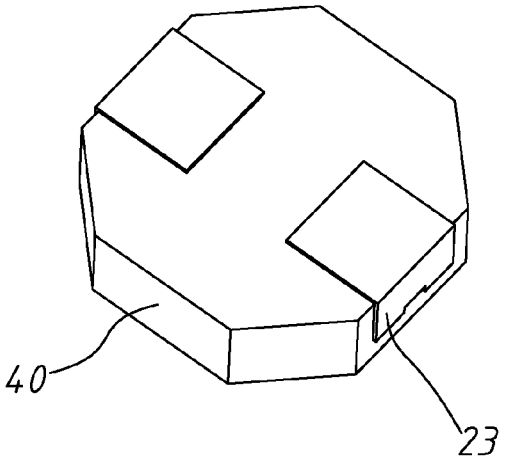

Referring to FIGS. 2-7, a method for making a shielded inductor involving an injection-molding technique in accordance with the present invention includes the steps of:

(101) winding a metal wire material into a conducting coil 10 and bending two distal ends of the metal wire material into a respective predetermined configuration of end piece 11 (see FIG. 2);

(102) bonding a magnetic core 30 to the center of the conductive coil 10 by a spot-gluing technique (see FIG. 3);

(103) making a metal sheet member into a metal bracket 20 having a frame body 21, a plurality of solder points 22 and a plurality of connection strips 23 (see FIG. 4);

(104) installing the conductive coil 10 in the metal bracket 20 and electrically soldering the end pieces 11 of the conductive coils 10 to respective soldering points 22 at the metal bracket 20 respectively (see FIG. 5);

(105) mixing a magnetic material with a plastic material and processing the mixture into plastic grains wherein the magnetic material is an alloy; the plastic material is selected from the polymeric material group of PE (polyethylene), PVC (polyvinyl chloride), PBT (polybothlene terephthalate), PC (polycarbonate), PS (polystyrene), ABS (acrylonitrile butadiene styrene, phenolic resin, LCP (liquid crystalline polymer) and epoxy resin that are suitable for injection-molding;

(106) employing an injection-molding technique to mold the plastic grains thus obtained onto the periphery of the conductive coil 10 at the metal bracket 20 to form an inductor body 40 (see FIG. 6); and (107) separating the respective connection strips 23 with the inductor body 40 from the metal bracket 21 and bending the separated connection strips 23 onto one of opposing top and bottom walls of the inductor body 40 (see FIG. 7), thereby finishing the manufacturing process.

During the fabrication of the aforesaid inductor body 40, a magnetic material is mixed with a plastic material and processed into plastic grains for molding onto the conductive coil 10 to form an inductor body 40. Employing the injection-molding technique facilitates fast fabrication and simplifies mold design. When the plastic grains are melted for injection-molding, it is flowable and practical for making inductor bodies 49 having different configurations. Therefore, the invention shows significant improvement over the prior art design that employs a pressure-molding technique.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A method for making a shielded inductor, comprising the steps of:

(a) winding a metal wire material into a conducting coil and bending two distal ends of said metal wire material into respective end pieces having a predetermined configuration;

(b) bonding a magnetic core to the center of said conductive coil by a spot-gluing technique;

(c) making a metal sheet member into a metal bracket having a frame body, a plurality of solder points and a plurality of connection strips;

(d) installing said conductive coil in said metal bracket and electrically soldering the two end pieces of said conductive coils to respective soldering points of said metal bracket;

(e) mixing a magnetic material with a plastic material and processing the mixture thus obtained into plastic grains;

(f) employing an injection-molding technique to mold said plastic grains thus obtained onto the periphery of said conductive coil to form an inductor body; and (g) separating the respective connection strips with said inductor body from said metal bracket and bending the respective connection strips onto one of opposing top and bottom walls of said inductor body.

2. The method for making a shielded inductor as claimed in claim 1, wherein said magnetic material is an alloy.

3. The method for making a shielded inductor as claimed in claim 1, wherein said plastic material is selected from the polymeric material group of PE (polyethylene), PVC (polyvinyl chloride), PBT (polybothlene terephthalate), PC (polycarbonate), PS (polystyrene), ABS (acrylonitrile butadiene styrene, phenolic resin, LCP (liquid crystalline polymer) and epoxy resin.

* * * * *